US007334664B2

(12) United States Patent
Fäβler

(10) Patent No.: US 7,334,664 B2
(45) Date of Patent: Feb. 26, 2008

(54) DEVICE FOR STORING GOODS

(75) Inventor: Norbert Fäβler, Rot/Haslach (DE)

(73) Assignee: Klaus Auto-Parksysteme GmbH, Aitrach (DE)

( * ) Notice: Subject to any disclaimer, the term of this patent is extended or adjusted under 35 U.S.C. 154(b) by 108 days.

(21) Appl. No.: 10/612,946

(22) Filed: Jul. 7, 2003

(65) Prior Publication Data

US 2004/0206578 A1 Oct. 21, 2004

(30) Foreign Application Priority Data

Jul. 5, 2002 (DE) ..... 202 10 520 U

(51) Int. Cl.
*B66F 7/10* (2006.01)
*B66F 7/16* (2006.01)
*B66B 5/12* (2006.01)

(52) U.S. Cl. ..... 187/208; 187/215; 187/363

(58) Field of Classification Search ..... 187/206, 187/207, 208, 209, 351, 359, 361, 362, 363; 254/387, 391

See application file for complete search history.

(56) References Cited

U.S. PATENT DOCUMENTS 289,905 A * 12/1883 Fitzroy ..... 187/363
635,521 A * 10/1899 Stokes ..... 187/363
4,531,614 A * 7/1985 Naegeli ..... 187/240
4,674,938 A 6/1987 Van Stokes et al. ..... 414/228
4,856,618 A * 8/1989 Isogai ..... 187/208
5,018,925 A * 5/1991 Ganser ..... 414/240
5,690,462 A * 11/1997 Fan et al. ..... 414/228
5,738,017 A * 4/1998 Behringer ..... 104/250
5,967,443 A * 10/1999 Green ..... 242/381.5
6,039,151 A * 3/2000 Ringel et al. ..... 187/207
6,382,358 B1 * 5/2002 Kritzer ..... 187/208
6,446,757 B1 * 9/2002 Taylor ..... 187/208

FOREIGN PATENT DOCUMENTS

DE 2759085 7/1978
DE 3125594 A1 6/1982
DE 3446337 C2 10/1985
GB 2285035 A 6/1995
GB 2285035 A * 6/1995

* cited by examiner

*Primary Examiner*—Peter M. Cuomo
*Assistant Examiner*—Eric E. Pico
(74) *Attorney, Agent, or Firm*—Jacobson Holman PLLC

(57) ABSTRACT

A device for storing goods, in particular vehicles, the goods being stored on at least one platform and the platform being guided on guides over a traverse path and a guide for traverse being provided. By the cooperation of the safety device arranged on the guide or device and the platform the platform is protected against undesired movement. The safety device is indicated by at least one locking unit and at least one locking element. The locking unit is rotatable and supported in such a way that the center of gravity of the locking unit is arranged off-center.

22 Claims, 3 Drawing Sheets

DEVICE FOR STORING GOODS

FIELD OF THE INVENTION

Figure 1:
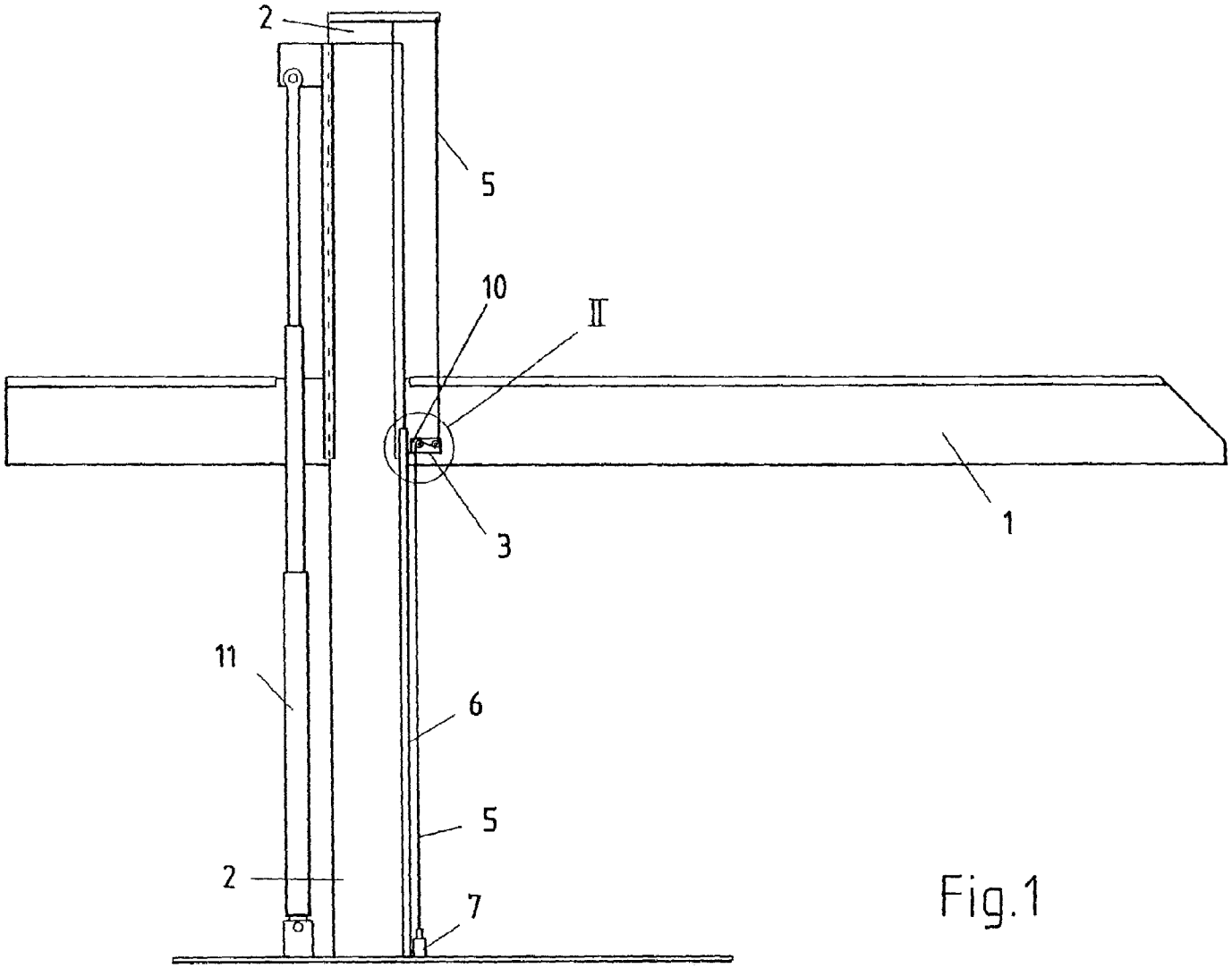

The invention refers to a device for storing goods, in particular vehicles, the goods being stored on at least one platform and the platform being guided traversable on guides over a traverse path, means being provided for traverse and the platform being secured against undesired movement by means of a co-operation of safety means arranged at the guide and platform.

BACKGROUND OF THE INVENTION

Devices for storing goods, in particular vehicles, are known as so-called car parking systems. These systems are characterized by a movable, vertically shifting platform where the vehicle is parked. By means of a lifting cylinder for example the platform is lifted. For that the platform is guided in lateral guides.

From the prior publication U.S. Pat. No. 4,674,938 a car parking system has become known where several platforms are arranged one above the other and these platforms can be jointed into each other during lowering. During lifting of a first platform a second platform is also pulled by separately arranged connecting means when the distance has been reached which is indicated by the connecting means.

The technical concept of this installation is very expensive, in particular through the fact that the whole device is guided on at least four stands over chains and is lifted with the help of a hydraulic cylinder. Here the platforms are secured against unintended movement by mechanic and/or electric control. It is provided here that a lever system triggers then an electric switch gear when, for example, one of the chains has no more sufficient tension force, respectively has been torn. A safety system working independently from the mechanic and electric devices against the unintentional movement, respectively lowering, of the platforms is not given according to the solution of the US publication.

From the prior publication GB 2 285 035 A a car parking system is known where the platforms are also guided on a frame comprising at least four stands. Here the platforms are lifted, respectively lowered, through a motor driven chain gear system. The safety is carried out by means of a safety device which is effective when, for example, the chain has been torn. Only in this case an impulse is triggered which then actuates a pull-type electromagnet in order to engage a safety device. The safety device comprises locking unit and locking element. The locking unit is provided on the platform and the locking element is located as punched tape slab on one of the stands. An independent effect of the safety device against an undesired movement of the platform is not given here according to this solution.

From the prior publication DE 31 25 594 A1 a lifting device, in particular a car lift, is known which has a vertically movable platform, which is carried by ropes and guided in columns. Here a control device for lifting and lowering the platform is provided, organs of touch being provided in order to check the tension of the ropes which should co-operate with a safety catch when an abnormal tension of at least one of the ropes occurs. The lifting device is characterised by the fact that the touch device is connected with a device for control of the blocking of the control means for lowering the platform in case an abnormal tension in at least one of the ropes is detected, which is adjusted in such a way that it triggers when a certain value has been exceeded. Furthermore the touch device is connected with the device for control and blocking the control device, however, it becomes only active when the tension in one of the ropes exceeds abnormally a predefined value. Therefore the safety device depends on the tension force of the ropes and only when certain failures have been detected there, the safety device becomes effective.

From the German prior publication 27 59 085 a safety catch for a lifting device, which comprises at least one cable, is known. This safety catch is constructed very complicated and comprises, for example, catches for co-operation with gear racks arranged on the stands and has a tilting member which is arranged rotatably on the car lift, an organ of touch being provided on the other hand which co-operates with the cable for lifting the platform. The tilting member is permanently under the effect of the spring force which tries to move the tilting member into the direction of the cable. In the case of a broken cable, and only then, the catches engage with gear racks. The catches also engage when an abnormal reduction of the tension in the cable occurs. Technically very complicated and expensive means are provided which should guarantee the effectiveness of the safety catch. For example, thus it is provided that the catch is connected with the tilting member in the position in which it is held through the stretched cable. Furthermore a device is provided which allows a free movement of the catch from a position of engagement into the gear rack until a position which is distant from it. Furthermore elastic means are provided in order to bring the catch into engagement with the gear rack. Additionally a control organ is provided to which the catch is connected via a transfer device for its release. Furthermore a transfer device is provided which has an organ whose length can be changed, which is held in a predefined position by further means, which are suited not to exceed a predefined force. From the features described above of the technical solution according to the disclosure 27 59 085 it becomes clear that, concerning the production and, in particular, the use, this safety catch is not suited to be used in the present modern car parking systems, which in particular need safety devices which are independent from technical means.

In the prior publication DE 34 46 337 C2 a speed limiter for an elevator provided with a safety catch is known. This speed limiter only becomes effective when a certain centrifugal force adjusted beforehand is exceeded. For example this speed limiter has to be brought into contact with the platform in such a way that changes of the speed in the movement of this platform lead to a triggering of the speed limiter. This solution is not suited, either, to provide an independently working safety device which secures the platform against unintentional movement.

Furthermore car parking systems are known where the platform is provided on stands which form the guides for the platform. It is usual here to provide the columns with catches which are stationary and guarantee that the platform can only be lowered to these catches. It is disadvantageous in this embodiment that the catches, because they are stationary, cannot be set before the platform has passed the catches. The consequence is that the platforms, when they are not moved completely into the upper position, do not have any safety devices. The platform can only be secured each time in the position where also the catches are provided. The consequence is that vehicles can be damaged, in the worst case even be demolished. It is also possible that persons get hurt when the platform is lowered without control.

BRIEF SUMMARY OF THE INVENTION

Coming from the prior art described above it is an object of the invention to suggest a solution which provides a securing of the platform against any unintentional movement.

In order to solve this problem the invention proposes a device for storing goods, in particular vehicles, where the goods can be stored on at least one platform and the platform is guided on guides over a traverse path, means being provided for traverse and the platform being secured against undesired movement by means of a co-operation of safety means arranged on the guide and the platform, which is characterized in that the locking unit is rotatable and supported in such a way that the center of gravity of the locking unit is located off-center so that the locking unit is in continuous active connection with the locking element as long as no power acting against the gravity is brought into the locking unit. Now such an arrangement allows providing the device for storing goods with a safety device which is permanently in active connection and has only to be opened when the platform of the device should be moved. In particular, lowering is only possible when the locking unit is released by a force acting against the gravity into the locking unit. By means of that now a device is created which guarantees a safety acting independently from the means of traverse, respectively lifting or lowering, of the platform. An additional arrangement of technical means like springs, magnets, cylinders or the like is not necessary anymore for the securing of the platform according the present solution.

According to an advantageous development it is provided that the safety means can be brought over the complete traverse path of the platform against the guide on several, respectively any desired, positions into active connection for interrupting the movement of the platform. It is now possible to secure the platform in many positions of the traverse path of the platform against the guide so that undesired movement processes of the platform can be avoided safely.

According to an advantageous development of the device according to the invention it is provided that the safety means secure the platform against undesired downward movements. This way of construction can prevent the undesired lowering of the platform. However, it can be secured simultaneously that an upward movement is possible despite the active connection of the safety device. This is, for example, possible when the locking unit is brought, respectively held, in the blocking position only by means of the gravity. However, during the upward movement it is possible to overcome the securing position by swinging away the locking unit from the locking element. For a stop, respectively a short lowering, however, the locking unit will be swung again into the securing position by its own weight. This is possible because of the arrangement of the center of gravity of the rotatable locking unit.

Such an embodiment has an advantage when, for example, mechanic securing means are arranged above the traverse path of the platform on the guide which allow a positive locking engagement on any discrete point, for example in the indentations of a gear rack. However, it is also possible, that perforated metal strips, chain/bolt connections or similar securing means are arranged over the complete traverse path which guarantee a securing on any point, that is any point where a positive locking or non-positive connection can be produced.

Of course it is a special advantage here when the securing means act as so-called passive securing means. The connection of the securing means to each other can only be released when a corresponding actuating organ is actuated which separates the connection, respectively allows a force to act on one of the securing means in such a way that the movement of the platform is then released. This guarantees that undesired movements of the platform against the guide cannot occur anymore so that damages of vehicles and persons can be avoided safely.

An advantageous development of the device according to the invention provides that the safety means can be brought over the complete traverse path of the platform against the guide on any point into active connection in order to interrupt the movement of the platform. In the sense of the invention "on any point" is understood when the platforms can only be determined in discrete steps, for example because of the toothing of a gear rack and the like. In the same way, however, also a securing can be achieved on any point, for example by a magnetic clutch or the like, which allows a continuous positioning, respectively determination, along the traverse path.

In an advantageous development the invention proposes that safety means are provided by a locking unit and a locking element. These locking units, respectively elements, may have different embodiments. Therefore it is, for example, possible to form the locking unit as a notch, a bolt, a wedge or a magnetic element. Conveniently the locking element can be formed as gear rack, as chain, as perforated plate, as magnetic metal strip or the like. Concrete embodiments of these elements will be described furthermore in the following passages.

An advantageous development of the device is characterized by an arrangement of the locking unit on the platform and of the locking element on at least one of the guides. Of course the principle can be realized vice versa, so that in another convenient embodiment the locking element is arranged on at least one of the guides. According to the chosen design it is therefore possible to keep the effort for the installation technique as low as possible. If, for example, the locking unit is arranged on the platform, it may be necessary to lead certain cables or mechanic actuating elements on this platform which might enlarge the effort. If the reversed principle of the arrangement of the locking element on the platform is chosen and the locking unit is arranged on at least one of the guides, for example, the effort with the movable cable, respectively actuating device, could be avoided.

It has also been found to be an advantage if the locking element is defined by a gear rack. This gear rack can be arranged along the guide over the complete traverse path of the platform. In this gear rack the locking unit engages with any indentation of the gear rack.

Another aspect of the invention is given by the design of the locking unit as a notch. Such a notch can be formed in such a way that it is correspondingly positive interlocking to a gear rack on the side of the notch which faces this gear rack. It can naturally also be provided that the notch has a bolt-shaped connection means which engages in correspondingly formed locking elements.

It has turned out to be convenient if the side of the notch which faces the locking element has at least one tooth formed in such a way that it can engage positive interlocking in each indentation of the gear rack along the traverse path of the platform. Thus a securing of the platform against the guide on any point of the traverse path is possible, that is always when an indentation of the gear rack can be connected to the correspondingly shaped tooth.

Of course it is, according to the invention, also provided that the locking unit is supported rotatably in such a way that the center of gravity is located, as already described, off-center. However, the center of gravity may be chosen here in such a way that the locking unit is not in continuos active connection if a force acting against the centrifugal force is brought into the locking unit. The force can be brought into the locking unit by a deflected cable, as described above. In the same way it is possible to provide a spring, a cylinder or the like, which exercise permanent power on the locking unit as long as the platform has to be fixed. Only when the platform shall be moved a power is exercised on the locking unit in order to bring the locking unit out of the active connection with the locking element. By means of that the principle of the kinematic reversal is realized.

Another aspect of the invention is given by the fact that the locking unit is held in continuos active connection with the locking element by means of the force of a power element, for example a spring or gravity, an opening element being provided which acts against the effective direction of the power element. This opening element then interrupts the active connection between locking unit and locking element when actuated.

According to an advantageous development of the invention the opening element is represented by an electromagnet, an electromotor, a pneumatic or hydraulic cylinder, a spring, a manual or mechanically supported, actuated cable pull or chain hoist or the like.

A particularly advantageous development of the invention is characterized by the fact that the locking unit can be rotated and is supported in such a way that the center is located off-center so that the locking unit is in continuos active connection with the locking element as long as no power acting against the gravity is brought into the locking unit. Thus a passive safety design is created in such a way that through the arrangement of the notch (weight and orientation around the rotational axis) it is achieved that the notch locks only in the not-impinged case, therefore is independently (passive) safe. By means of that in a simple way a dead man's circuit is realized.

Another aspect of the invention is given by the fact that for introducing the adjustment power the locking unit comprises an opening element and as opening element for example an electromagnet, electro-motor, a pneumatic or hydraulic cylinder, a spring, a manual or mechanically supported actuated cable pull or chain hoist is provided.

Furthermore it is convenient if there are signal transmitters, like electric all-or-nothing relays, pressure sensors and/or speed sensors on the means for traverse of the platform which co-operate with the opening element arranged on the means for the traverse of the platform in such a way that the actuating of the opening element embraced by the locking unit is blocked, respectively prevented, on the means of traverse when the usual working conditions deviate.

According to the invention it has also been found that it is an advantage if the locking unit is indicated by a design like a connecting link which is in continuous active connection with the locking element and has an opening element for opening the active connection. The design like a connecting link refers here actually to a safety device in the form of fixing the connecting links by means of the arrangement of a sliding block within an oval opening which has a reniform design, can then be fixed, respectively be released, when corresponding forces act on the sliding block, respectively when the position of the cable within the opening is changed.

According to a development of the device according to the invention it is provided that the locking unit is arranged rotatably on the platform and the opening element is formed by a cable and/or a chain which is guided over deflection rollers and the length of which can be changed.

However, it is also possible that the locking unit has only at least one deflection over which the cable is guided in the shape of an "S".

The device according to the invention is also characterized by the fact that the cable is attached to the upper end of at least one of the guides, preferably the upper end of a stationary column, and to the lower end of at least one guide or to the floor.

According to a particular embodiment of the invention it is provided that the rotatably supported locking unit is arranged on the platform and the locking element preferably designed as gear rack is arranged on the frame of the device, preferably on the stationary column. Here at least two deflection rollers are provided on the locking unit, over which the cable is guided which is attached to the upper end of the device and connected with the opening element arranged on the floor or on the lower end of the device, which effects a movement, in particular a pulling movement, on the cable when the opening element is actuated, introducing a power acting against the gravity into the locking unit, which rotates the locking unit in such a way that it disengages from the locking element. The design of the invention presented here can be realized comparatively easy and is mechanically very reliable. The arrangement here is chosen in such a way that it works on each point of the platform along the traverse path in a simple way. No cables or other parts have to be taken with which have to be connected to changeably active lengths of connecting lines correspondingly which would mean additional effort.

A particular advantage of the invention is the fact that the cable runs over the deflection rollers along the complete traverse path of the platform. By means of that an actuating of the locking unit on each point of the traverse path is achieved, the deflection of the cable over the deflection rollers in the locking unit making it possible that this rotatably supported locking unit can be moved by that and therefore be controlled accordingly. For that purpose at least one of the axes of the deflection roller is located outside the rotational axis of the locking unit. In order to guarantee the automatic relapse of the locking unit into the catching, safe position it is provided that the center of gravity is not located on the rotational axis of the locking unit resulting securely in a tilting moment.

It has proved to be an advantage when the device is designed in such a way that the opening element is provided for changing the length of the cable. Here the cable is guided over or through the opening element. By means of the change of the active length of the cable, respectively of a chain, then the force can be introduced to the locking unit, which is for example supported rotatably on the platform, so that also, by means of this arrangement, a force acting against the gravity is introduced into the locking unit. The active connection between platform and guide, respectively locking unit and locking element, is also opened by that.

It has also proved to be an advantage, if the opening element is indicated by a working cylinder driven by spring force, hydraulic or electrical and connected with a cable. These are only a few embodiments possible by the invention, which in no way are to be understood as limiting.

Another aspect of the device according to the invention is given by the fact that an actuating element is provided for actuating the opening element which is arranged in such a way that the operator can actuate this actuating element from a safety area. For example, the simplest way is a switch for actuating an opening element designed as an electromagnet. This switch may be arranged next to the device so that the operator can operate this actuating element after leaving the vehicle and the device from a safety area without the risk of an accident. Of course, all opening elements mentioned so far, be they mechanically or electrically or pneumatic, hydraulic operated, can be designed by such a solution.

A development of the device according to the invention is characterized by the fact that the locking unit releases the platform only when the actuating element is actuated. This is an additional safety to the passive safety already in operation.

According to the invention it has also been found to be an advantage if in the case where the device is located inside a building, the cable or the cables are attached to the corner, respectively wall, of the building. This refers to the upper ends of the cables. The lower ends of the cables are attached, as already described before, either to the guides, respectively to the floor of the building.

The invention is, according to an advantageous development, also characterized by the fact that the cable, respectively the chain, the gear rack and the locking unit are protected against unintentional intervention by a cover which can be removed, if desired. Thus another aspect of the accident protection is taken into consideration, besides the cover also serves for protection of the cable pull and the other safety means so that they will work reliably.

Of course, the cables may also be attached to a frame where the device is arranged. Namely, the devices for storing goods are not only put up inside buildings, but also outside as devices formed in metal frames. However, it is also possible to provide the devices with a frame and to arrange them in large buildings, for example in halls. In this case it is provided that the cables are attached directly to the frame.

Another aspect of the invention is characterized by the fact that the locking unit is represented by a centrifugal brake. This centrifugal brake will lock the platform against the guide every time when the platform has a movement speed which deviates from the usual speed of movement of the platform. The centrifugal brake will then be operated automatically. The usual speed of the platform is set on this centrifugal brake. When the platform exceeds this usual, given speed the centrifugal brake comes into action. Other embodiments are possible here as those which are used for example in passenger elevators, lifts and the like.

An advantageous development of the invention is given by the fact that the safety means are brought into active connection by means of magnetic forces. It is, for example, possible, to arrange electromagnets either on the platform or on the guides in such a way that, if the current is switched on, the magnetic forces of these electromagnets hold the platform against the guide. This is possible in each position of the traverse path of the platform against the guide.

BRIEF DESCRIPTION OF THE DIFFERENT VIEWS OF THE DRAWINGS

Figure 3:
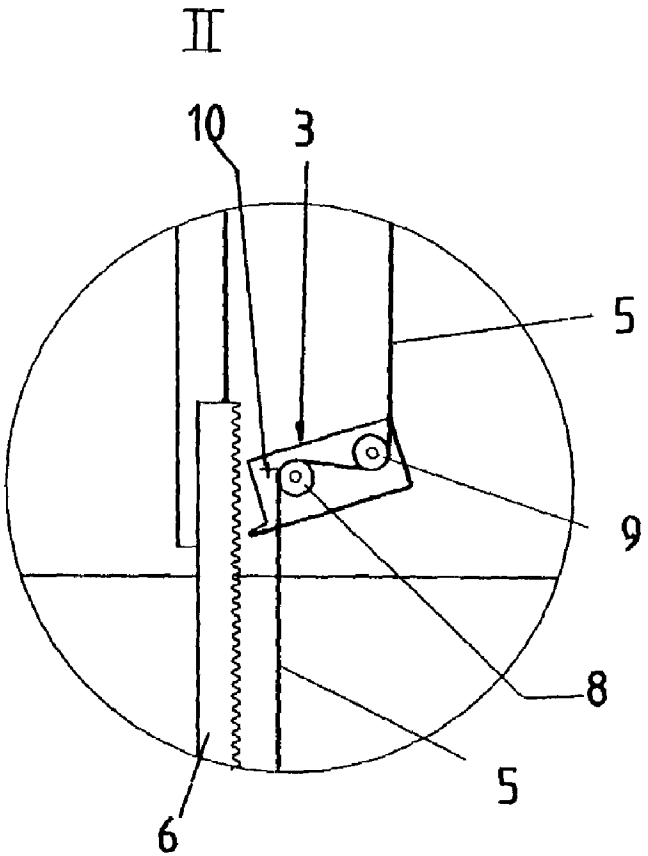
Figure 2:
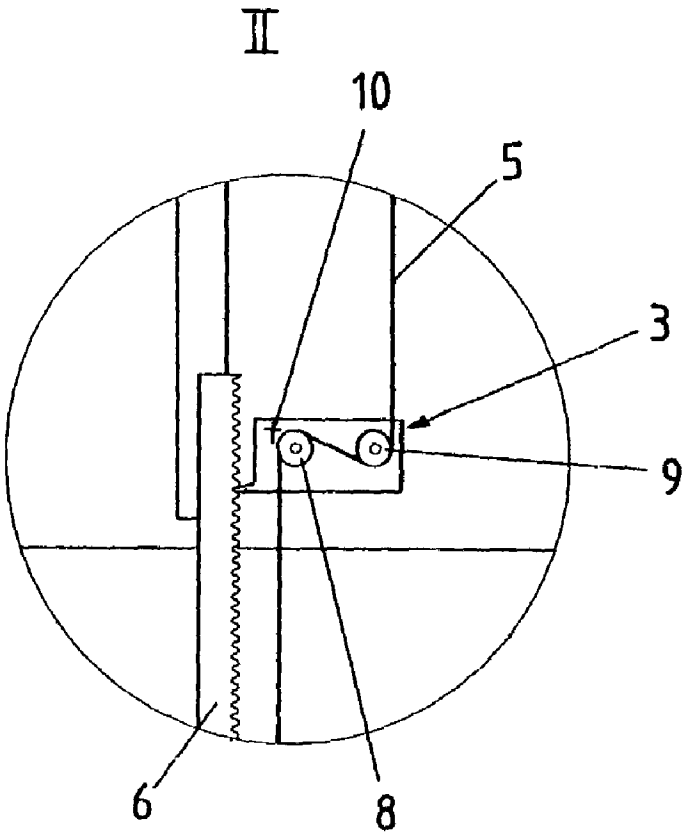

The invention is described in the following more detailed in embodiments and figures. The figures show:

FIG. 1 the side view of an embodiment of the invention;

FIGS. 2 and 3 detail sections of FIG. 1; and

Figure 4:
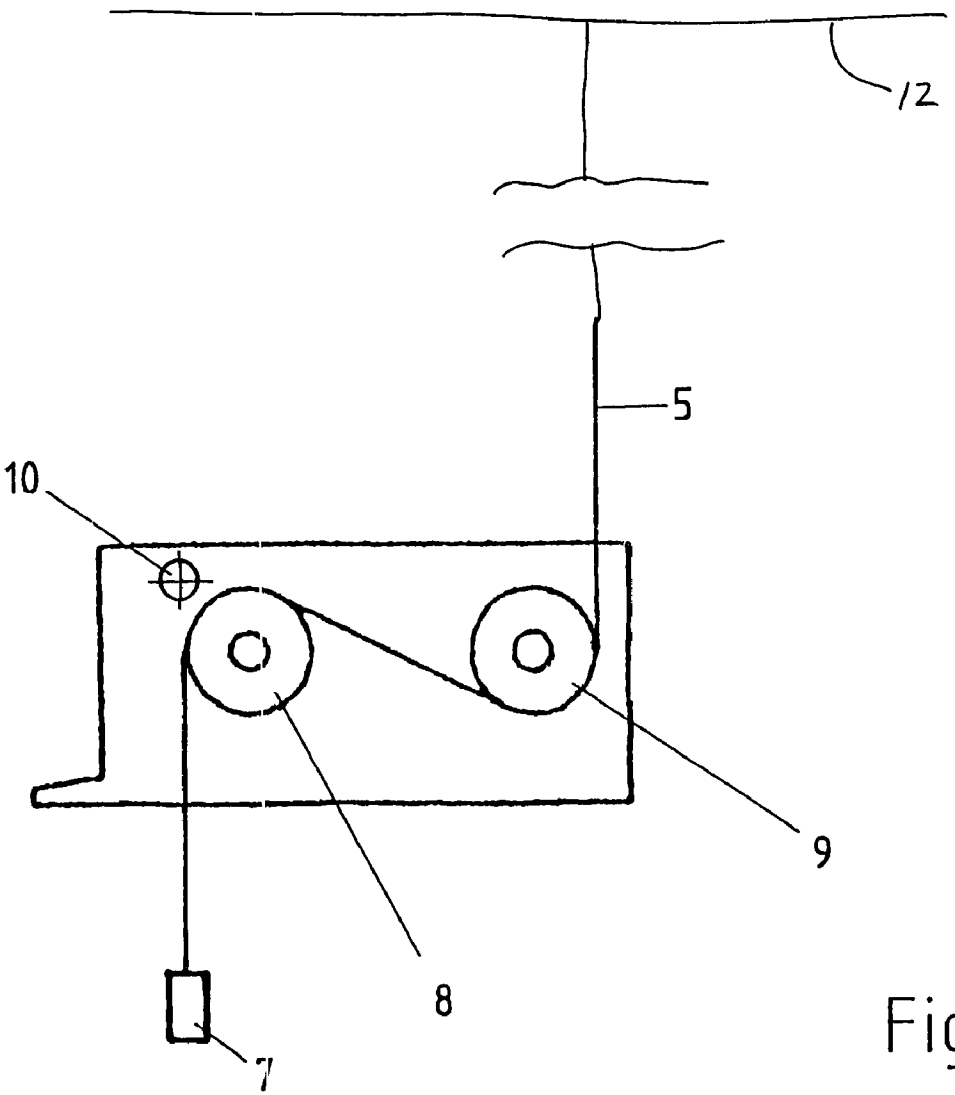

FIG. 4 the embodiment of a locking unit.

DETAILED DESCRIPTION OF THE PREFERRED EMBODIMENTS

FIG. 1 shows in a side view a device for storing goods, in particular a car parking system, the platform 1 being arranged on a guide 2 designed as a column. A hydraulic cylinder 11 serves for adjusting the height of the platform 1. On the platform 1 a locking unit 3 is arranged which is characterized in this particular embodiment by the fact that it is arranged rotatably on the platform 1, the center of gravity being off-center, so that the locking unit 3 comes already just by means of gravity into the position where the locking unit 3 is in active connection with the locking element 6 which is a gear rack in this illustration. The locking unit 3 designed as a notch has two deflection rollers over which a cable 5 is guided in the form of an "S". The cable 5 is, on the one hand, attached to the guide 2 designed as a column and, on the other hand, to the floor. On the floor an opening element 7 is arranged. This opening element 7 is designed in such a way that it leads to a change of position of the cable 5 when the element is actuated.

In a preferred embodiment of the invention already described this opening element 7 is designed as an electromagnet. In this form it is therefore possible to arrange actuating means very simply in such a way that a cabling of the platform 1 is not necessary.

In the illustration according to FIG. 1 the principle of the invention can be understood very easily. However, this is only one possible embodiment of the invention and is not limiting in any way. A notch is shown which runs together with and on the platform 1 and which is rotatably supported on an axis and through which a cable 5 is guided. The cable 5 is, as already mentioned, angled in the form of an "S" and guided over the rollers 8 and 9 (see FIGS. 2 and 3). In the locked position the cable 5 is elongated and the weight of the notch results in a turning moment of the notch around the rotational axis 10 in such a way that a tooth designed on the notch engages in the gear rack which is provided on the guide 2 designed as a column. The notch is disengaged in such that the opening element 7 designed as an electromagnet shortens the active length of the cable 5. By means of that the notch moves around the rotational axis so that the tooth of the notch is released from the gear rack. Now the platform 1 can be shifted against the guide 2. If the actuating element, which is not shown, is released again for the opening element 7 the active length of the cable 5 is lengthened again and the notch falls back again into the locking position because of gravity. Such a passive safety design is very smart. It is characterized by the fact that the notch is always locked if not impinged, that is independently passive. This safety device in the form of a dead man's circuit has an especially great importance in particular for devices for storing vehicles because very high demands are made on these devices concerning safety.

In the FIGS. 2 and 3 the section indicated with II in FIG. 1 is shown. In FIG. 2 the locking unit 3 designed as a notch can be seen. The guide of the cable 5 over the two deflection rollers 8 and 9 is in clear evidence. A tooth designed on the notch engages into the locking element 6 designed as a gear rack.

In FIG. 3 the same section can be seen, however, the cable 5 is in the shortened position so that the notch is in the released position by means of the force introduced into the locking unit 3 which acts against gravity. By the way, the reference numbers have been explained already so that a new presentation is not necessary.

FIG. 4 shows an enlargement of an embodiment of the locking unit 3 which is designed here as a notch. The rotational axis is indicated by the reference number 10. It is located off-center in such a way that the notch only through the gravity moves always into the lower position which leads to a locking. On the side of the locking unit 3 facing the locking element 6 a tooth has been designed which engages, as already described, then into the locking element 6 which is designed as a gear rack.

In an embodiment not shown the notch moving together with and on the platform 1 can be actuated by adjustment means. These adjustment means can be presented, as already shown, by the cable which can be altered in its length, respectively by a chain whose length can be altered. However, these adjustment means can be also means which can be designed purely mechanical which may have, for example, the form of a simple angle, the form of a releasable and fixable spring through hydraulic or pneumatic cylinders and the like.

In another embodiment of the device according to the invention it is also possible that co-operating means are provided on the guides 2 and on the platform which can be actuated because of a certain centrifugal force when the platform 1 exceeds a certain speed. This can be carried out, for example, by the fact that safety wedges are actuated over spindles driven by rollers when the centrifugal force of these spindles exceeds a certain speed. Of course, this speed can be adjusted. However, it is also possible that these safety devices controlled by centrifugal force can be designed electro-mechanic, electrical, electronically, hydraulic and so on. For example, it can also be provided that, as it is provided in state-of-the-art elevator devices, centrifugal governors driven over rollers actuate the safety elements when a certain speed is exceeded.

It is, of course, possible according to the principle of kinematic reversal to arrange the locking unit 3 on the platform 1 and the locking element 6 at least on one of the guides 2, respectively the locking element 6 on the platform 1 and the locking unit 3 on at least one of the guides 2.

In an advantageous development of the device according to the invention it is provided that safety is realized through the traverse path of the platform 1 by magnetic means. For example, the guide 2 can be designed as a contrapole of an electromagnet which is arranged on the platform 1. When the electromagnet is actuated the magnetic force actuated by that is sufficient to hold the platform 1 in this position. It is, of course, possible to combine this magnetic safety with mechanic safety means. Conveniently such a device is also provided on both sides of the platform 1 and thus on both guides 2.

According to an advantageous embodiment of the device according to the invention on the platform a locking unit 3 is arranged through which a cable is guided. This locking unit 3 has a design like a connecting link. That means that it can block the platform 1 on any point by means of the movement of the cable. For that it is only necessary to guide the cable on the ceiling or wall of a building 12 (as shown in FIG. 4) and on the floor, similar to the backdrop of a theatre. The design like a connecting link then leads to a clamping of the cable blocking the platform. Of course, here also a movement of the guide designed like connecting link is possible.

Although the invention has been described by exact examples which are illustrated in the most extensive detail, it is pointed out that this serves only for illustration and that the invention is not necessarily limited to it because alternative embodiments and methods become clear for experts in view of the disclosure. Accordingly changes can be considered which can be made without departing from the contents of the described invention.

The invention claimed is:

1. Device for storing vehicles, the device comprising at least one platform, at least one guide for guiding the at least one platform over a path traverse to the at least one platform, a lifting device for moving the at least one platform along the traverse path, a safety device acting independently of the lifting device for securing the at least one platform against undesired movement and for preventing movement of the at least one platform, the safety device including at least one locking unit and at least one locking element for preventing any unintentional movement of the at least one platform, two deflection rollers mounted on the locking unit and being movable therewith, and an opening element formed of a cable or chain guided around the two deflection rollers, the locking unit being rotatably mounted on the at least one platform about a rotational axis and being freely rotatable with a center of gravity of the locking unit being located off-center from the rotational axis so that the locking unit tends to move towards a continuous active connection with the locking element by the force of gravity as long as there is an absence of power acting against gravity applied to the locking unit.

2. Device according to claim 1, wherein the safety device secures the platform against undesired downward movement.

3. Device according to claim 1, wherein the safety device is arranged along the traverse path of the at least one platform against the at least one guide to interrupt movement of the at least one platform.

4. Device according to claim 1, wherein the locking element is arranged on at least one of the guides.

5. Device according to claim 1, wherein the locking element includes a gear rack.

6. Device according to claim 5, wherein a notch is provided as the locking unit.

7. Device according to claim 6, wherein a side of the notch facing the locking element has at least one tooth designed to positively engage and interlock into each indentation of the gear rack along the traverse path of the at least one platform.

8. Device according to claim 1, wherein the locking unit is held in a position by a power element embracing the opening element acting against an effective direction of the power element, and which is activated only when the at least one platform is moved along the guides.

9. Device according to claim 8, wherein power which is effective against the power element is brought by the cable into the locking unit.

10. Device according to claim 8, wherein an actuating element is provided for actuating the opening element arranged in such a way that an operator actuates the actuating element.

11. Device according to claim 10, wherein the locking unit releases the at least one platform only when the actuating element is actuated.

12. Device according to claim 1, wherein the lifting device cooperates with the opening element in such a way that actuating of the opening element embraced by the locking unit is blocked.

13. Device according to claim 1, wherein the locking unit is in the continuous active connection with the locking element and has the opening element for opening the active connection.

14. Device according to claim 13, wherein the opening element acts through the cable on the locking unit and to remove the active connection with the locking element.

15. Device according to claim 1, wherein the two deflection rollers guide the cable in a shape of an "S".

16. Device according to claim 1, wherein the cable runs along the traverse path of the at least one platform over the deflection rollers.

17. Device according to claim 1, wherein the locking unit includes a centriftigal brake which is actuated automatically by an adjustable speed deviating from a normal traverse speed of the at least one platform.

18. Device according to claim 1, wherein the safety device is brought into active connection by magnetic forces.

19. Device for storing vehicles, the device comprising at least one platform, the at least one platform being guided on guides and the at least one platform being traversable over a path traverse to the at least one platform, means for moving the at least one platform along the traverse path and the at least one platform being secured against undesired movement by safety means for preventing movement of the at least one platform, the safety means including at least one locking unit and at least one locking element, the locking unit being rotatable and supported in such a way that a center of gravity of the locking unit is located off-center so that the locking unit is in continuous active connection with the locking element as long as there is no power acting against gravity applied to the locking unit, said locking element having an opening element for opening the active connection, and a cable attached to an upper end of at least one of the guides and to a lower end of at least one guide, the opening element acting through said cable on the locking unit for removing the active connection with the locking element.

20. Device for storing vehicles, the device comprising at least one platform, the at least one platform being guided on guides and the at least one platform being traversable over a path traverse to the at least one platform, means for moving the at least one platform along the traverse path and the at least one platform being secured against undesired movement by safety means for preventing movement of the at least one platform, the safety means including at least one locking unit and at least one locking element, the locking unit being rotatable and supported in such a way that a center of gravity of the locking unit is located off-center so that the locking unit is in continuous active connection with the locking element as long as there is no power acting against gravity applied to the locking unit, and the locking unit being provided on the at least one platform and the locking element including a gear rack provided on a frame, at least two deflection rollers provided on the locking unit over which a cable being guided which is attached to an upper end of the frame and connected with an opening element arranged on the floor which then effects a movement of the cable when the opening element is actuated, bringing a force acting against gravity to the locking unit which turns the locking unit in such a way to disengage the locking unit from the locking element.

21. Device for storing vehicles, the device comprising at least one platform, at least one guide for guiding the at least one platform over a path traverse to the at least one platform, a lifting device for moving the at least one platform along the traverse path, a safety device acting independently of the lifting device for securing the at least one platform against undesired movement and for preventing movement of the at least one platform, the safety device including at least one locking unit and at least one locking element for preventing any unintentional movement of the at least one platform, the locking unit including two deflection rollers, and an opening element formed of a cable or chain guided around the two deflection rollers, the locking unit being rotatably mounted on the at least one platform about a rotational axis and being freely rotatable with a center of gravity of the locking unit being located off-center from the rotational axis so that the locking unit tends to move towards a continuous active connection with the locking element by the force of gravity as long as there is an absence of power acting against gravity applied to the locking unit, the locking unit being in the continuous active connection with the locking element and having the opening element for opening the active connection, the opening element acting through the cable on the locking unit and to remove the active connection with the locking element, the cable being attached to a building.

22. Device for storing vehicles, the device comprising at least one platform, at least one guide for guiding the at least one platform over a path traverse to the at least one platform, a lifting device for moving the at least one platform along the traverse path, a safety device for securing the at least one platform against undesired movement and for preventing movement of the at least one platform, the safety device including at least one locking unit and at least one locking element for preventing any unintentional movement of the at least one platform, the locking unit being rotatably mounted about a rotational axis and being freely rotatable with a center of gravity of the locking unit being located off-center from the rotational axis so that the locking unit tends to move towards a continuous active connection with the locking element by the force of gravity as long as there is an absence of power acting against gravity applied to the locking unit, and the locking unit being in the continuous active connection with the locking element having an opening element for opening the active connection, the opening element acting through a cable on the locking unit and for removing the active connection with the locking element, the cable being attached to a building.

* * * * *